United States Patent [19]

Troncoso, Jr.

[11] 4,183,346

[45] Jan. 15, 1980

[54] ARCHERY BOW IN COMBINATION WITH AN ADJUSTABLE DRAW CHECK

[76] Inventor: Fernando V. Troncoso, Jr., 1851 S. Orange Ave., Monterey Park, Calif. 91754

[21] Appl. No.: 848,146

[22] Filed: Nov. 3, 1977

[51] Int. Cl.[2] ..... F41B 5/00

[52] U.S. Cl. ..... 124/24 R; 116/67 R; 124/88

[58] Field of Search ..... 124/41 A, 24 R, 88, 124/86, 35 A; 116/67 R

[56] References Cited

U.S. PATENT DOCUMENTS

| | | | |
|---|---|---|---|
| 3,443,558 | 5/1969 | Peck | 124/88 X |
| 3,499,414 | 3/1970 | Frydenlund | 124/41 A |
| 3,669,059 | 6/1972 | Stuart | 124/88 X |
| 3,866,592 | 2/1975 | Carella | 124/24 R |
| 4,061,107 | 12/1977 | Smith | 124/41 A X |

*Primary Examiner*—Richard C. Pinkham
*Assistant Examiner*—William R. Browne
*Attorney, Agent, or Firm*—Donald E. Nist

[57] ABSTRACT

The improved draw check of the present invention includes a support plate, a device for affixing the rear surface of the support plate to the window of an archery bow adjacent the bow arrow rest, and a resilient arm secured, preferably pivotably secured, to the exposed front surface of the support plate. The arm is a single blade and includes a portion adapted to contact the outer margin of an arrow when the latter is on the arrow rest for shooting from the bow. That portion of the arm includes a leading end and a trailing end, the leading end having a part projecting toward the support a greater distance than the trailing end projects toward the support.

With this arrangement, the archer can draw an arrow (while on the bowstring) on the arrow rest back past the check's leading end, thus causing it to suddenly move toward the support, and then further back past the trailing end, causing a further sudden movement of the draw check toward the support, in both cases signaling the position of the arrow.

5 Claims, 10 Drawing Figures

ARCHERY BOW IN COMBINATION WITH AN ADJUSTABLE DRAW CHECK

BACKGROUND OF THE INVENTION

1. Field of the Invention

The present invention generally relates to archery equipment and more particularly to an improved archery arrow draw check, customarily called a clicker.

2. Prior Art

Various types of archery draw checks have been employed in the past to signal to the archer the position of the arrow point relative to the bow, i.e. how far back the archer has drawn the arrow on the bowstring. Obviously, the distance an arrow is drawn back on the bowstring will determine the impact point of the arrow on a target, once the drawn bowstring is released. In order to assure the exact same draw length from arrow to arrow, and thus improved accuracy, archers now commonly employ archery draw checks, most of which are of the so-called clicker type. A clicker is typically a bladed draw check adapted to be releasably flexibly positioned on the outside of the arrow shaft when the latter is on the arrow rest. The draw check is biased toward the bow window. Just as the arrow point is drawn back past the clicker blade, the blade snaps against the bow window, making an audible click and reflexively triggering the release of the bowstring. There are also some types of draw checks which depend on activation of lights, etc. to substitute for the audible click in signaling the archer to release the bowstring. Draw checks and clickers generally permit the archer to view the target uninterruptedly, rather than having to occasionally visually check the position of the arrow point during the process of drawing the bowstring, as in the case of the archer who shoots without such devices.

It is of some importance in precision shooting, particularly with a bow having a heavy draw weight or one close to the endurance limit of the archer, particularly upon long-continued shooting, to first have a preliminary signal that the arrow point is nearing the release point in its rearward travel, and then to have the actual release signal. Otherwise, the archer may inadvertently initially draw "short", due to fatigue, and then have to strain unduly to move the arrow point back past the release point. This is particularly true because during a tournament, certain of the draw muscles may tend to swell, physically impeding as long a draw as initially.

Moreover, the newest type of bullet-shaped arrow points contain no ring groove in which a single clicker blade can catch to signal the position of the point.

Accordingly, practice has clearly indicated the need for a two-signal clicker or draw check for precision shooting. Most such clickers are relatively heavy, expensive, and cumbersome, comprising two separate flexible blades, one in front of the other along the arrow draw path, so that the forward clicker clicks first and then the rearward clicker. Such blades are fixedly connected at one end to their support plates so that their forward and rearward position relative to the bow window cannot be changed, without detaching their support from the bow window and refastening it.

Accordingly, there is a need for an improved draw check which will provide the advantages of conventional two-signal clickers but which is less bulky and expensive and has improved adjustability, as well as improved signaling capability.

SUMMARY OF THE INVENTION

The improved draw check of the present invention satisfies the foregoing needs. It is substantially as set forth in the Abstract above. Thus, it accomplishes with a single resilient arm the functions of multiple arm clickers, while being smaller, lighter, less expensive and more adjustable. Its single arm can be made to pivot so as to vary its position along the arrow draw path to accommodate arrows of various lengths and archers of differing draw lengths. Moreover, the distance between the point at which it first signals and the point at which it again signals i.e. the point at which it signals to release the bowstring, can be varied. In a preferred embodiment, the arm or blade is configured to prevent a forwardly creeping arrow point (after initially drawing it back past the first signal point) from inadvertently shoving against the blade and pushing it forward. Thus, the draw check of the invention has improved capabilities. Further features of the present invention are set forth in the following detailed description and accompanying Drawings.

DRAWINGS

DETAILED DESCRIPTION

FIGS. 1, 2, 6, 7 and 8

Figure 1:
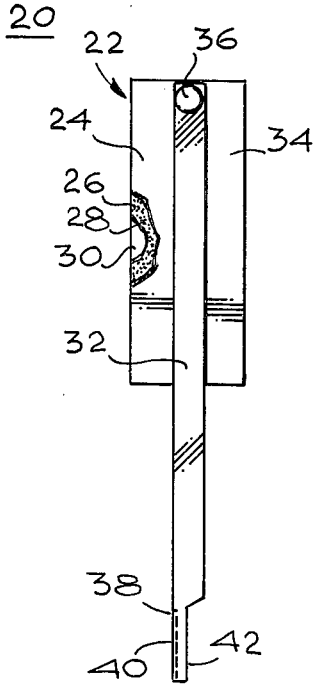
FIG. 1 is a schematic side elevation, partly broken away, of a first preferred embodiment of the improved draw check of the invention.
Figure 2:
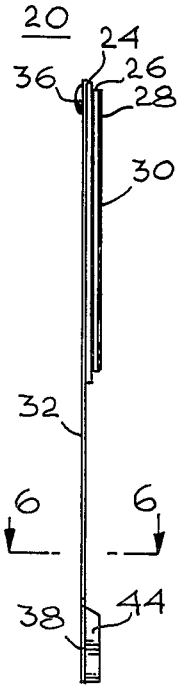
FIG. 2 is a schematic rear elevation of the draw check of FIG. 1.
Figure 6:
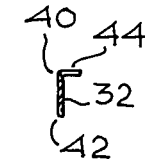
FIG. 6 is a schematic cross-section of the arrow-engaging portion of the blade of the draw check of FIG. 2, taken along the section line 6—6 of FIG. 2.

Now referring more particularly to the first preferred embodiment of the draw check of the invention, it is schematically depicted in FIGS. 1 and 2. Thus, draw check 20 is shown which comprises a support 22 in the form of a flat elongated plate 24 of metal, plastic, wood or the like to the back of which is adhesively secured a pad 26 having an adhesive coating 28 on its back covered by a pealable layer 30 (of waxed paper or the like) for attachment to the side window of an archery bow above the bow handle and arrow rest (not shown).

Draw check 20 also includes a flat flexible resilient elongated blade 32 (of metal, plastic, etc.) pivotably secured to the front 34 of plate 24 by a screw or rivet 36 or the like. The lower portion 38 of blade 32 is adapted to engage the outer margin of an archery arrow when the latter is on the bow arrow rest. Portion 38 has a leading end 40 and trailing end 42 spaced therefrom. Leading end 40 includes a portion 44 which projects inwardly toward plate 24 at about a right angle to the main plane of blade 32, as shown particularly in FIGS. 2 and 6. Portion 44 thus extends further toward plate 24 than does end 42.

When it is desired to use draw check 20, layer 30 is first pealed off and draw check 20 is affixed (by coating 28) in place in an archery bow window so that portion 38 is slightly above the arrow rest. An arrow is then fed between the bow window and blade 32 by moving blade 32 temporarily away from the bow window. Blade 32 now rides on the outside of the arrow but is biased towards plate 24. The rear end of the arrow is then connected to the bowstring while the shaft is allowed to rest on the arrow rest.

During shooting, the bowstring is first drawn by the archer, carrying the arrow with it. During such draw, the tip of the arrow point first passes back past portion 44, causing it to spring towards plate 24 and cause blade 32 to strike the point to signal by sound and vibration the position of the arrow point. Upon further drawing of the bowstring, the tip of the arrow point passes back past end 42, and blade 32 springs toward the bow window, causing portion 44 to strike it to give the bowstring release signal (again sound and vibration). Since there is only a single blade 32, draw check 20 can be made light and inexpensive.

Figure 7:
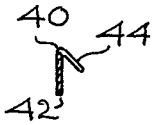
FIG. 7 is a schematic cross-section of the same orientation as FIG. 6 and showing the blade portion of FIG. 6 bent to reduce the distance between the leading and trailing ends thereof.

If desired, the distance between ends 40 and 42 can be adjusted by bending portion 44 toward end 42, as shown in FIG. 7, or away therefrom. Moreover, blade 32 can be pivoted around rivet 36 to adjust it to the proper draw length for a particular arrow length and archer.

Figure 8:
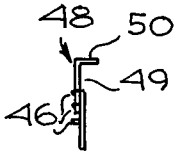
FIG. 8 is a schematic cross-section of the arrow-engaging portion of a modified blade of the improved draw check of the invention, in the same orientation as FIG. 6 and showing means for adjusting the spacing between the leading and trailing ends thereof.

FIG. 8 illustrates a modification of portion 38 to further facilitate adjustment of the distance between the leading and trailing ends thereof. Thus, blade 32 in portion 38 may be specially configured, with spaced prongs 46 projecting away from plate 24 and adapted to releasably secure through openings (not shown) a detachable piece 48 comprising a forwardly extending segment 49 and an inwardly directed sigment 50 (the latter corresponding to portion 44). Piece 48 can be detached and repositioned nearer or farther away from the rear of portion 48, as desired.

Figure 3:
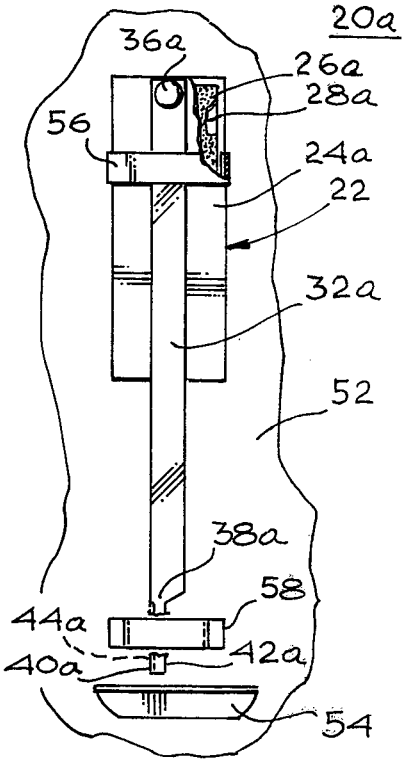
FIG. 3 is a schematic side elevation, partly broken away, of a second preferred embodiment of the improved draw check of the invention mounted in the window portion of an archery bow above the arrow rest.
Figure 5:
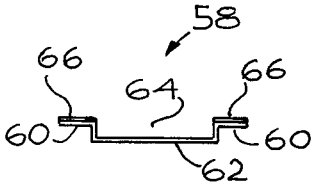
FIG. 5 is an enlarged schematic top plan view of the percussive member of the draw check of FIG. 3.
Figure 4:
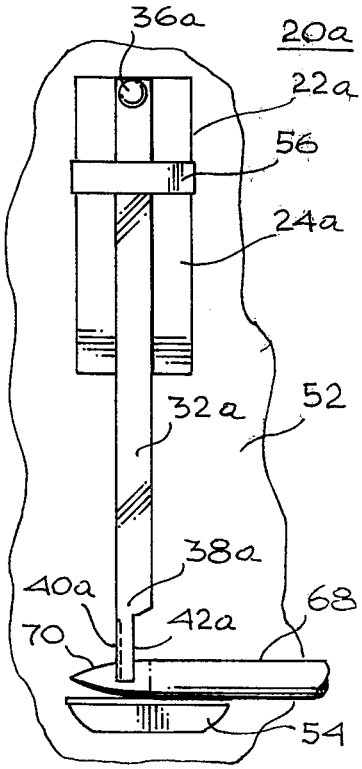
FIG. 4 is a schematic side elevation of the draw check of FIG. 3 mounted in an archery bow window without a percussive member but disposed around an archery arrow on the bow arrow rest.

FIGS. 3, 4 and 5

A second preferred embodiment of the improved draw check of the invention is schematically depicted in FIGS. 3 and 4. Thus, FIG. 3 shows a draw check **20*a* in place in the window 52 of an archery bow, above an arrow rest 54. Draw check 20*a* is similar to draw check 20, and components thereof which are substantially the same as those of draw check 20 bear the same numerals but are succeeded by the letter "a". Thus, draw check 20*a* includes support 22*a* comprising plate 24*a*, pad 26*a* and adhesive coating 28*a*, and a blade 32*a* secured to plate 24*a* by rivet 36*a*. Portion 38*a* of blade 32*a* includes leading end 40*a*, trailing end 42*a* and inwardly projecting portion 44*a***.

Draw check **20*a* also includes a vertically slideable horizontally disposed friction band 56 over blade 32*a* and secured around the side edges of plate 24*a*. Because of this, pad 26*a* is of smaller dimensions than pad 26. The vertical position (which can be adjusted) of band 56 determines the force biasing blade 32*a* towards plate 24*a* and thus the strength of the clicks when the first and second signals are given in the manner described for draw check 20**.

Moreover, draw check **20*a* includes a tympanic or percussive member 58 mounted on window 52 above rest 54 and adjacent to portion 38, for audible striking by blade 32 during said signaling. Member 58 is preferably metallic and, as shown in FIG. 5, includes peripheral portions 60 and a central portion 62 offset with respect thereto so as to provide a space 64 therebehind. Portions 60 may bear adhesive strips 66 to facilitate attachment to window 52. Thus, draw check 20*a* provides means to assure loud clear signals during its use. Draw check 20*a* can be made inexpensively of materials similar to those of draw check 20**.

FIG. 4 shows draw check **20*a* without percussive member 58, but with an arrow 68 with a smooth ringless bullet-shaped nose 70 mounted on rest 54, portion 38*a*** engaging the outer margin thereof, ready to be used as described above.

Figure 9:
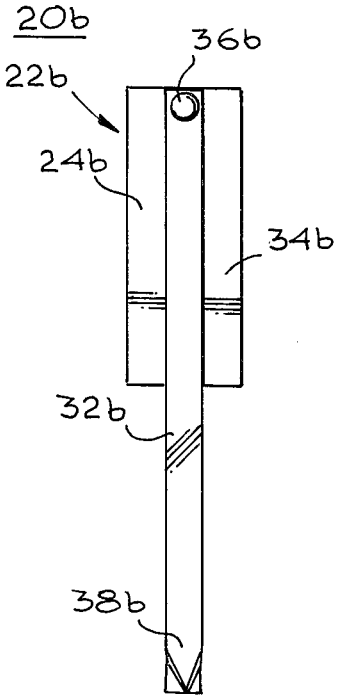
FIG. 9 is a schematic side elevation of a third preferred embodiment of the draw check of the present invention; and, FIG. 10 is an enlarged schematic fragmentary view of the arrow-contacting side of the arrow-engaging portion of the blade of the draw check of FIG. 9.
Figure 10:
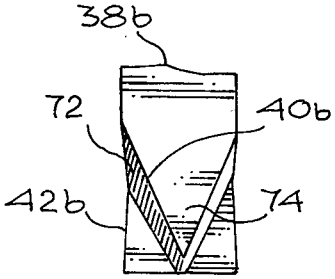

FIGS. 9 and 10

A third preferred embodiment of the improved draw check is schemactically depicted in FIGS. 9 and 10. Those components which are similar to those of draw check 20 bear the same numerals but are succeeded by the letter "b". Thus, draw check **20*b* is shown which includes support 20*b* and its usual components, as well as blade 32*b* secured to the front 34*b* of plate 24*b* by rivet 36*b***.

However, draw check **20*b* includes means to prevent misallignment of blade 32*b* during shooting. Thus, portion 38*b* of blade 32*b* is configured so that immediately behind its effective leading end 40*b* is an area 72 sloped, preferably gradually sloped, away from plate 24*b* and toward trailing end 42*b*. Leading end 40*b* may include a wedge-shaped or V-shaped plateau 74, as shown particularly in FIG. 10. Sloped area 72 prevents the tip of an arrow from pushing blade 32*b* forward and pivoting around rivet 36*b*, if that tip is first drawn back past end 40*b* and then allowed to creep forward. Pushing blade 32*b* forward would misplace it relative to the proper position at which the release signal should be given and thus would require reallignment before further shooting. Accordingly, draw check 20*b* has improved capabilities. It can be fabricated of materials similar to those of draw checks 20 and 20*a***.

Various other modifications, changes, alterations and additions can be made in the present draw check, its components and parameters. All such modifications, changes, alterations and additions as are within the scope of the appended claims form part of the present invention.

What is claimed is:

1. An archery bow and draw check comprising in combination:

a. an archery bow having an arrow rest; and, b. an improved archery arrow draw check comprising, in combination i. a support, ii. means attaching one side of said support to said archery bow adjacent said arrow rest, and iii. a resilient arm secured to and biased towards the opposite side of said support, said arm including means adapted to contact the outer margin of an arrow when the arrow is on said rest, said means having a segment projecting toward said support and a trailing edge rearward of said segment, said segment having a rearwardly sloped rear portion spaced from said trailing edge, whereby when an arrow is on said rest between said arm and said support, and when the point of said arrow is drawn down said sloped portion said means moves toward said support to provide a first signal, and when said point is subsequently drawn back further to a point past said trailing edge, said means again moves toward and contacts said support to provide a second separate signal spaced in time from said first signal.

2. The improved device by claim 1 wherein said arm is pivotally secured to said support for adjustment of its position relative thereto.

3. The improved device of claim 1 wherein said arm comprises a flat blade pivotably connected adjacent its upper end to said support, wherein said support comprises a plate and wherein said attaching means comprises an adhesively coated layer.

4. The improved device of claim 1 wherein said arm is a single generally flat blade.

5. The improved device of claim 1 wherein said segment projecting toward said support is generally V-shaped with said rear part of said V gradually sloped.

* * * * *